US008322442B2

(12) United States Patent
Voss

(10) Patent No.: US 8,322,442 B2
(45) Date of Patent: Dec. 4, 2012

(54) WELL UNLOADING PACKAGE

(75) Inventor: Robert K. Voss, Peterculter (GB)

(73) Assignee: Vetco Gray Inc., Houston, TX (US)

( * ) Notice: Subject to any disclaimer, the term of this patent is extended or adjusted under 35 U.S.C. 154(b) by 229 days.

(21) Appl. No.: 12/635,294

(22) Filed: Dec. 10, 2009

(65) Prior Publication Data

US 2010/0230110 A1 Sep. 16, 2010

Related U.S. Application Data

(60) Provisional application No. 61/158,896, filed on Mar. 10, 2009.

(51) Int. Cl.
*E21B 21/00* (2006.01)
*E21B 37/00* (2006.01)

(52) U.S. Cl. ..... 166/368; 166/338; 166/344; 166/351; 166/311

(58) Field of Classification Search ..... 166/368, 166/338, 344, 347, 351, 352, 311, 369, 68, 166/105; 175/207, 217; 137/15.01, 15.04, 137/15.05

See application file for complete search history.

(56) References Cited

U.S. PATENT DOCUMENTS 2,523,091 A * 9/1950 Bruce ..... 166/185
3,750,753 A * 8/1973 Bernard ..... 166/309
4,063,602 A * 12/1977 Howell et al. ..... 175/7
4,149,603 A * 4/1979 Arnold ..... 175/7
4,291,772 A * 9/1981 Beynet ..... 175/5
4,501,330 A * 2/1985 Garcia ..... 166/297
5,287,923 A * 2/1994 Cornette et al. ..... 166/278
6,457,529 B2 * 10/2002 Calder et al. ..... 166/368
6,460,621 B2 * 10/2002 Fenton et al. ..... 166/347
6,745,851 B1 * 6/2004 Edvardsen ..... 175/5
6,966,367 B2 * 11/2005 Butler et al. ..... 166/105
7,011,152 B2 * 3/2006 Soelvik ..... 166/65.1
7,066,247 B2 * 6/2006 Butler et al. ..... 166/105
7,121,344 B2 10/2006 Fenton et al.
7,201,229 B2 * 4/2007 White et al. ..... 166/368
7,431,081 B2 * 10/2008 Stave ..... 166/236
7,481,270 B2 * 1/2009 Shepler ..... 166/105
7,497,266 B2 * 3/2009 Fossli ..... 166/358
7,677,329 B2 * 3/2010 Stave ..... 175/5
7,740,074 B2 * 6/2010 White et al. ..... 166/347
7,882,896 B2 * 2/2011 Wilson et al. ..... 166/368
7,913,764 B2 * 3/2011 Smith et al. ..... 166/358
7,914,266 B2 * 3/2011 Kerr et al. ..... 417/410.1
7,938,190 B2 * 5/2011 Talamo et al. ..... 166/358
7,958,948 B2 * 6/2011 Stave ..... 175/7
2007/0131429 A1 6/2007 Brammer
2007/0144743 A1 * 6/2007 White et al. ..... 166/368
2007/0246220 A1 10/2007 Fenton

OTHER PUBLICATIONS

A. Amin, "Subsea Development From Pore to Process," Oilfield Review, 2005.

* cited by examiner

*Primary Examiner* — Matthew Buck
(74) *Attorney, Agent, or Firm* — Bracewell & Giuliani LLP

(57) ABSTRACT

A method of unloading a well using a modular adapter having a pump, a pump suction line, and a pump discharge line. The adapter is connected to a subsea wellhead assembly so that the pump suction line communicates with a main bore in the wellhead assembly and the pump discharge line communicates with a production line attached to the wellhead assembly. The production line is isolated from the main bore and the pump draws fluid from within the well and discharges it into the production line. After unloading the well, the adapter can be removed and moved to another location for well unloading.

9 Claims, 2 Drawing Sheets

WELL UNLOADING PACKAGE

CROSS REFERENCE TO RELATED APPLICATIONS

This application claims priority to and the benefit of U.S. Provisional Application Ser. No. 61/158,896, filed Mar. 10, 2009, the full disclosure of which is hereby incorporated by reference herein.

FIELD OF THE INVENTION

This invention relates in general to production of oil and gas wells, and in particular to a device and method for unloading and clean up of fluids from a well.

DESCRIPTION OF RELATED ART

Subsea wellbores are formed from the seafloor through subterranean formations lying underneath. Systems for producing oil and gas from subsea wellbores typically include a subsea wellhead assembly set over a wellbore opening. A typical subsea wellhead assembly includes a high pressure wellhead housing supported in a lower pressure wellhead housing and secured to conductor casing that extends downward past the wellbore opening. Wells are generally lined with one or more casing strings coaxially inserted through, and significantly deeper than, the conductor casing. The casing strings are suspended from casing hangers landed in the wellhead housing. One or more tubing strings are provided within the innermost casing string; that among other things are used for conveying well fluid produced from the underlying formations. A production tree mounts to the upper end of the wellhead housing for controlling the well fluid. The production tree is typically a large, heavy assembly, having a number of valves and controls mounted thereon Conventional or vertical type production trees typically include a production bore and a tubing annulus access bore. Tubing hangers associated with conventional trees land in the wellhead housing and are equipped with a production passage and an annulus passage. The tubing hanger annulus passage communicates with a tubing annulus surrounding the tubing. Access to the tubing annulus is necessary to circulate fluids down the production tubing and up through the tubing annulus, or vice versa, to either kill the well or circulate out heavy fluid during completion. After the tubing hanger is installed and before the drilling riser is removed for installation of the tree, plugs are temporarily placed in the tubing hanger passages. Isolation tubes on the production tree bottom surface stab into the tubing hanger passages as the tree lands on the wellhead housing.

Different from the conventional tree is a horizontal tree, which includes a production passage but not a parallel tubing annulus access bore. Tubing hangers associated with horizontal trees land within the tree after the horizontal tree is installed. The tubing hanger is lowered through the riser, which is typically a drilling riser. Access to the tubing annulus is available through choke and kill lines of the drilling riser. The tubing hanger does not include an annulus passage; instead a bypass extends through the tree to a void space located above the tubing hanger. This void space communicates with the choke and kill lines when the blowout preventer is closed on the tubing hanger running string.

Well fluids can be produced from a subsea well after the wellhead assembly is fully installed and the well perforated (completed). However, the piping necessary to convey well fluids from the well to a processing facility often lags the wellhead assembly completion. During this lag time, the well may be sealed with its completion and/or drilling fluids remaining in the wellbore. Additionally, the rig used to drill the well will have been moved to another drilling site. When the well is brought on-line for producing formation fluids, the completion/drilling fluid is usually forced from the well by the formation pressure. In some instances though, the well may be overbalanced by static head from the completion/drilling fluid column, thus preventing the well from producing. The overbalanced condition can be corrected by removing the completion/drilling fluid and/or replacing it with a lighter fluid. Either action generally requires returning a drilling rig to the well to draw the fluid from the well or pump light fluid into the well. Additionally, hydrocarbon containing well fluid from the formation might be intermixed with the completion/drilling fluid being removed from the well. Since hydrocarbons generally require processing or remediation, a barge is typically required since drilling rigs are not equipped to properly handle hydrocarbons. Due to the cost associated with a barge, as well as the cost and time spent returning a drilling rig to a well site, subsea overbalanced well conditions are undesirable.

SUMMARY OF THE INVENTION

Disclosed herein is a method of removing fluid from a subsea wellbore and subsea wellhead assembly. In this example, the wellbore is in fluid communication with a producing formation, but the wellbore contains a non-production fluid that impedes natural flow from the producing formation. The method includes providing a pressurizing module subsea, where the module includes a pressurizing device with an entrance and an exit, a suction line having an end coupled to the pressurizing device entrance and a discharge line having an end coupled to the pressurizing device exit. The pressurizing module is coupled with the wellhead assembly so that the suction line is in fluid communication with the non-production fluid in the wellbore. The pressurizing device is activated to draw the non-production fluid from the wellbore, through the suction line, through the pressurizing device, and into the discharge line. When a sufficient amount of the non-production fluid is withdrawn so that the production fluid is flowing naturally, the pressurizing device can be deactivated and disconnected device from the wellhead assembly. The pressurizing module can be relocated to another subsea wellhead assembly and the steps repeated. The method can include operating the pressurizing device until substantially all the non-production fluid removed from the wellbore. The pressurizing device can be lowered from a vessel onto the wellhead assembly. In one example, the pressurizing device is coupled to a production tree and both are lowered onto a subsea wellhead assembly. The subsea wellhead assembly can be a previously installed production tree and the pressurizing device is lowered from a vessel onto the production tree. The pressurizing module can include a housing, an axial bore in the housing that extends through a bottom side of the housing, and wherein the suction line is in fluid communication with the axial bore. The bottom side of the housing can be mounted onto the wellhead assembly and the axial bore can be in fluid communication with an axial production bore formed in the wellhead assembly. The discharge line may be in fluid communication with a production flow line that is in selective fluid communication with a non-production fluid processing facility; in this example the method can further involve flowing the fluid from the discharge line into the production flow line and selectively flowing, the fluid to the processing facility. A production port can be provided on the wellhead assembly that is in fluid communication with the subsea wellbore, in this example an end of the suction line opposite the pressurizing device can be connected to the production port.

Also disclosed herein is a method of completing a subsea well. In this embodiment, a drilling vessel can be employed to install production tubing through a wellhead assembly and into a cased well, and also used to perforate the well while the wellbore contains non-production fluid. The drilling vessel can be removed with the non-production fluid remaining in the wellbore. A second vessel can return to the well to lower a pumping system into engagement with a subsea wellhead housing of the wellhead assembly. Non-production fluid can be drawn from the subsea well through the wellhead assembly using the pumping system, the pumped fluid can be discharged from the pumping system into a well fluids production line. When a significant portion of the non-production fluid has been withdrawn from the wellbore, the pumping system can be moved to a different wellhead assembly connected to a different subsea well for use in drawing fluid from the different subsea well. The non-production fluid can contain entrained hydrocarbons flowing (or have flowed) from an earth formation through the perforations. The non-production fluid can be directed to a processing facility where the hydrocarbons are removed from the non-production fluid. Alternatively, the pumping system can be operated at least until the well begins to flow naturally through the perforations due to earth formation pressure. The drilling vessel can be used to install a production tree and the pumping system can be landed on the production tree. The pumping system can be coupled to a production tree on the second vessel and both lowered onto a wellhead housing of the wellhead assembly. The pumping system can be raised onto the second vessel and transported to the different subsea well using the second vessel.

Another alternative method is disclosed that is for unloading a non-production fluid from subsea wellbores. This method includes providing a wellhead assembly over a subsea wellbore. The wellhead assembly can include wellhead housing mounted on the sea floor, a production tree connected on top of the wellhead housing, a production bore that axially extends through the wellhead housing and production tree, and that is in fluid communication with the wellbore, and a production port formed through the production tree having an end in fluid communication with the production bore. The method can include perforating an earth formation intersected by the wellbore and leaving non-production fluid in the wellbore, connecting an end of a production line to the production port, providing a pressurizing module that has, a pressurizing device with a fluid inlet and a fluid outlet. The method can then also include lowering the pressurizing module onto and coupling the pressurizing module with the wellhead assembly, so that the fluid inlet is in fluid communication with the non-production fluid in the production bore, providing fluid communication between the fluid outlet of the pressurizing device and the production line, blocking fluid communication between the production line and the production port, using the pressurizing module to flow non-production fluid from the wellbore, through the pressurizing module, and to the production line, and after the non-production fluid is substantially withdrawn from the wellbore, decoupling the pressurizing device from the wellhead assembly and allowing production fluid from the earth formation to flow to the production line due to the internal pressure of the earth formation. The wellhead assembly of this example can include a choke body attached to the production port the fluid inlet of the pressurizing device stabs into the choke module.

DETAILED DESCRIPTION OF THE INVENTION

Figure 2:
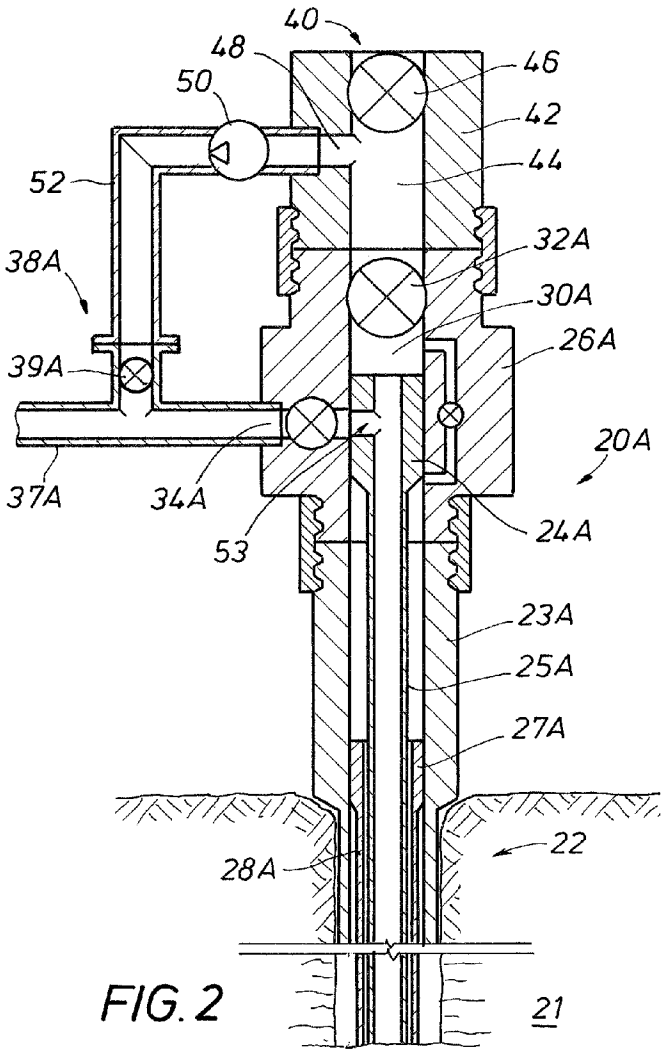
FIG. 2 is a sectional view of an alternate embodiment of a subsea wellhead assembly with a pump module.

The apparatus and method of the present disclosure will now be described more fully hereinafter with reference to the accompanying drawings in which embodiments are shown. This subject of the present disclosure may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout. For the convenience in referring to the accompanying figures, directional terms are used for reference and illustration only. For example, the directional terms such as "upper", "lower", "above", "below", and the like are being used to illustrate a relational location.

It is to be understood that the subject of the present disclosure is not limited to the exact details of construction, operation, exact materials, or embodiments shown and described, as modifications and equivalents will be apparent to one skilled in the art. In the drawings and specification, there have been disclosed illustrative embodiments of the subject disclosure and, although specific terms are employed, they are used in a generic and descriptive sense only and not for the purpose of limitation. Accordingly, the subject disclosure is therefore to be limited only by the scope of the appended claims.

Figure 1:
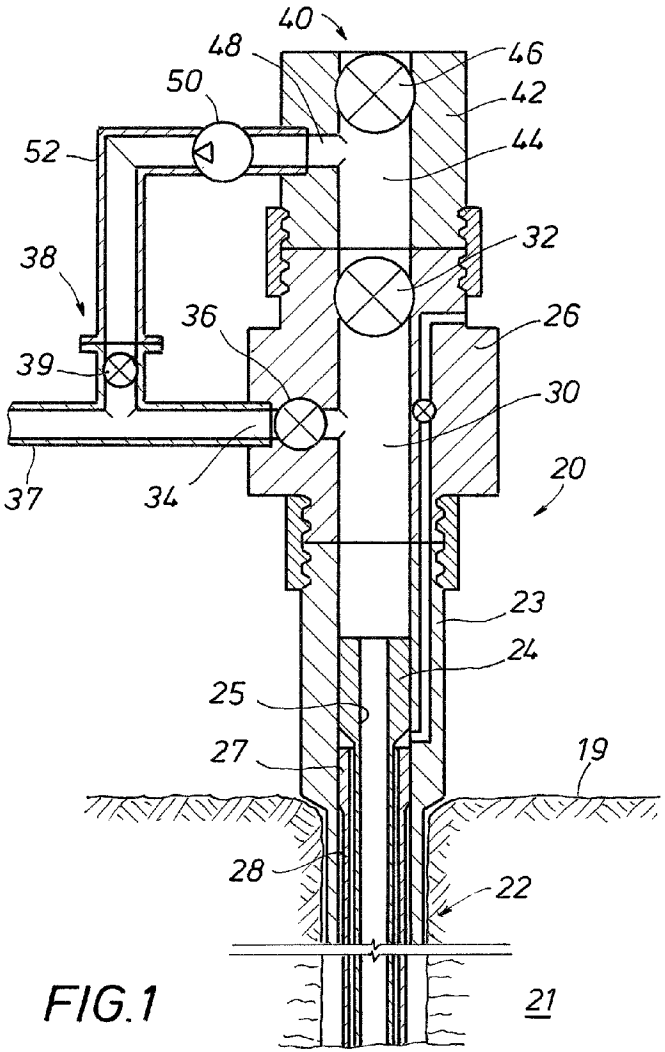
FIG. 1 is a sectional view of an embodiment of a subsea wellhead assembly with a pump module.

With reference now to FIG. 1, shown on the sea floor 19 is a wellhead assembly 20 disposed over a subsea formation 21. A wellbore 22 intersects the formation 21 and registers with the wellhead assembly 20. The wellhead assembly 20 includes an annular wellhead housing 23, and in this example, it has a tubing hanger 24 mounted in its inner circumference. Production tubing 25 is suspended from the tubing hanger 24 and is shown projecting into the wellbore 22. A production tree 26 coaxially mounts on the wellhead housing 23. A casing hanger 27 is also coaxially mounted within the wellhead housing 23 below the tubing hanger 24. Casing 28 attaches to the casing hanger 27 and extends into and lines the wellbore 22. A production bore 30 axially passes through the wellhead housing 23 and the production tree 26. A swab valve 32 in the production bore 30 selectively provides access to the production bore 30 from the upper end of the production tree 26. Produced fluids can flow from the production bore 30 through a production port 34 shown laterally extending from the production bore 30 and through the production tree 26 to its outer surface. A wing valve 36 can regulate flow through the production bore 34. A production line 37 is shown connected to the production tree 26 and registering with the production port 34. A branch fitting 38, shown as an upward facing receptacle, connects onto the production line 37 and includes an isolation valve 39 therein for selectively controlling flow through the branch fitting 38. As noted below, the branch fitting 38 can be a receptacle for a flow choke. Tree 26 could have an isolation tube on its lower end that stabs sealingly into the upper end of the tubing hanger 24. Also, hydraulic control lines can extend from the tree 26.

Still referring to FIG. 1, an example of a pump module 40 is shown having an annular adapter body 42 with an axial bore 44 shown coaxially mounted on the production tree 26. The bore 44 is alignable with the production bore 30. Activating the swab valve 32 puts the production bore 30 and bore 44 into fluid communication. The bore 44 is accessible through a block valve 46 shown in the bore 44 and above a suction line 48 formed laterally through the adapter body 42. The suction line 48 connects to a suction side of a pressurizing device; the pressurizing device illustrated in FIG. 1 is a pump 50. Example types of pumps include positive displacement pumps, centrifugal pumps, gear pumps, progressive cavity pumps, reciprocating pumps, radial pumps, and axial pumps, to name but a few. The pump 50 discharge is illustrated routed to the production flow line 37 through an exit line 52 shown connecting to the branch fitting 38. Other forms of coupling are available between the discharge line 52 and the production flow line 37.

The pump module 40 can be used such as when the wellbore 22 is in an overbalanced condition that prevents pressure in the formation 21 from forcing fluid through the wellhead assembly 20 and into the production flow line 37. In one example of use, the wing valve 36 and block valve 46 are closed and the isolation valve 39 and swab valve 32 opened. The pump 50 is activated that in turn draws fluid into its suction side from within the adjacent suction line 48. Evacuating fluid from the suction line 48 into the pump 50 locally reduces fluid pressure thereby inducing fluid flow from the bore 44, production bore 30, and production tubing 28 to flow towards the pump 50. Fluid in the production tubing 28 can be any type of fluid, such as completion fluid, drilling fluid, or a fluid mixture. The fluid exiting the pump 50 flows through the discharge line and into the production flow line 37. The closed wing valve 36 directs the discharged fluid through the branch fitting 38 and to the production flow line 37. The discharged fluids may be pumped through the production flow line 37 and through a manifold (not shown) to a disposal or storage site. Optionally, the fluids may be pumped to an FPSO vessel (Floating Production Storage and Offloading), a rig, or workboat.

The wellhead assembly 20 of FIG. 1 is referred to as a vertical or conventional wellhead. However, as shown in FIG. 2, the pump module 40 described herein can be used with other types of wellhead assemblies, such as the horizontal wellhead assembly 20A schematically illustrated. In this embodiment, the tubing hanger 24A is mounted within the production tree 26A and above the wellhead housing 23. Thus the tubing hanger 24A is elevated from its position in the conventional assembly 20. A bore 53 laterally formed through the tubing hanger 24A provides production fluid flow between the production tubing 25A and the production port 34A. Thus in spite of the differences between the vertical wellbore assembly 20 of FIG. 1, and the horizontal assembly 20A of FIG. 2, the pump module 40 can be installed and used on either type of wellbore assembly 20, 20A. Accordingly, operating the pump module 40 with the horizontal wellhead assembly 20A includes opening isolation valve 39A and swab valve 30A while the wing valve 36A and block valve 46 are closed. Fluid in the wellbore 22 flows through the production tubing 25A exiting the tubing hanger 24 on its way through the swab valve 32A. Closing the wing valve 36A prevents fluid from flowing through the lateral bore 53. Fluid exiting the swab valve 32A enters the bore 44 and then the suction line 48 where it is directed to the pump 50. After being pressurized in the pump 50, the fluid exits to the discharge line 52 and is routed to the branch fitting 38A and into the production line 37A. As noted above, from the production line 37A, the fluid can make its way through a manifold to a disposal or storage site, an FPSO vessel, a rig, or workboat.

Figure 3:
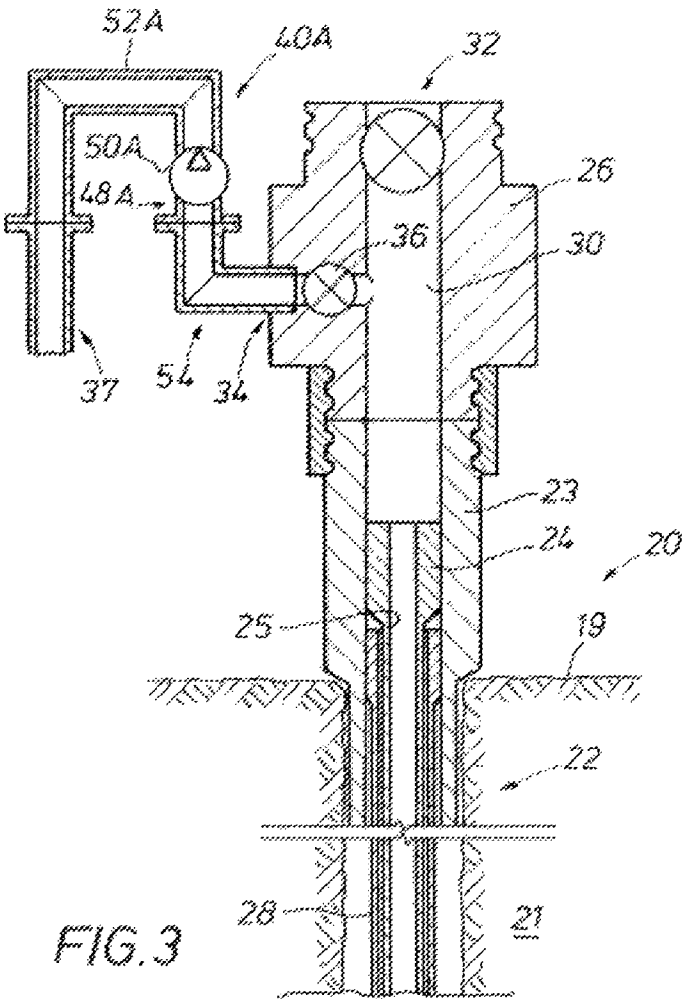
FIG. 3 is an alternative embodiment of a pump module for use with a subsea wellhead assembly.

An alternate embodiment of the pump module 40A is illustrated in a side sectional view in FIG. 3. In this example the pump module 40A includes a suction line 48A upstream and connected to an inlet of a pump 50A. The pump module 40A also includes discharge piping 52A illustrated flangedly connected between an exit of the pump 50A and the production flow line 37. It should be pointed out that the piping connections illustrated herein can be something other than flanged, such as a weld, a threaded connection, a coupling, and the like. In the example of FIG. 3, the suction line 48A of the pump module 40A attaches to an end of a choke body 54. The choke body 54 as shown includes a tubular member, with its end opposite the suction line 48A affixed to the production tree 26 at the production port 34. The choke body 54 may control flow from the wellhead assembly 20 to ensure proper well management. Flow control by The choke body 54 can include reducing cross sectional area within The choke body 54, where the reduced cross section can be permanent, such as with a reduced diameter member, or actively reducing cross section with a control valve type element. The wellhead assembly 20 shown in FIG. 3 is a conventional type with the tubing hanger 24 landed in the wellhead housing 23. However, the pump module 40A of FIG. 3 is useable with any type of wellhead housing. The embodiment of the pump module 40A of FIG. 3 couples in line with the typical flow path. Thus the wing valve 36 should be in the open position so that fluid in the tubing 25 and/or production bore 30 can flow through the wall of the production tree 26, past the wing valve 36, through the suction piping 48A, and to the pump 50A.

Figure 4:
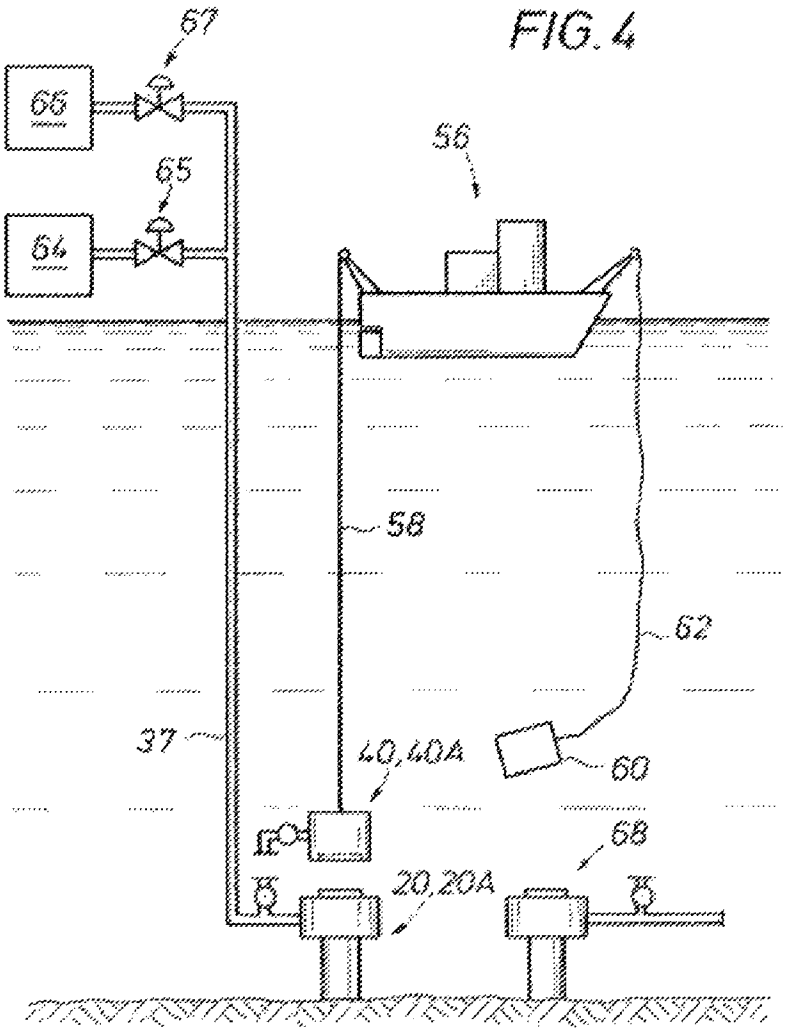
FIG. 4 is a side view of the pump module of FIG. 1 being retrieved from a subsea wellhead assembly.

Shown in a side view in FIG. 4, is an example of using a work boat 56 to attach or remove the pump module 40, 40A from the wellhead assembly 20, 20A. A retrieval line 58 suspended from the work boat 56 attaches to the pump module 40, 40A. A remotely operated vehicle (ROV) 60 can be deployed from the work boat 56 on a control line 62 to assist with attaching to the pump module 40, 40A and disconnecting it from the wellhead assembly 20, 20A. The conventional wellhead assembly 20 can be perforated before attaching the production tree 26 and plugs (not shown) set within the well. In this example, the production tree 26 can be lowered to the wellhead assembly 20 from the work boat 56. The pump module 40 can be coupled to the production tree 26 before it is lowered subsea, or after it is attached to the wellhead assembly 20. Any plugs in the production bore 30 can be removed as needed. An example of a device and method for plug removal is provided in Fenton et al., U.S. Pat. No. 7,121,344, assigned to the assignee of the present application and incorporated for reference herein in its entirety. After completion fluid has been pumped from the wellbore 22, valve 30, 30A is closed and valve 34, 34A is opened.

In one example of the system and method described herein, a drilling rig (not shown) is coupled via a riser (not shown) to the wellhead assembly 20. The non-produced fluids are introduced into the wellbore 22 via the drilling rig and remain therein after the drilling rig has been disconnected and relocated. The pump module 40, 40A can be installed and operated at some time after disconnecting and moving the drilling rig and production fluid flow lines have been installed and connected to the wellhead assembly 20, 20A. Alternatively, the pump module 40, 40A can be coupled with the wellhead assembly 20, 20A using the drilling rig before it relocates. As discussed above, the pump module 40, 40A may remove non-production fluids, such as completion and/or drilling fluids, from within the wellbore 22 and the production tubing 25. After unloading the wellbore 22 and removing enough of the non-production fluids to "underbalance" the wellbore 22, fluid can flow from the formation 21 into the wellbore 22. The pump module 40, 40A can also be used to remove substantially all the non-production fluid, all of the non-production fluid, all of the production fluid and some of the subterranean fluid from the formation 21. Wellbore 22 production can be initiated before, or after retrieving the pump module 40 from the wellhead assembly 20.

Since the fluids removed using the pump module 40 may have entrained hydrocarbons that require processing, these fluids can be routed from the pump module 40 to a processing facility 64. As noted previously, the processing facility 64 can be remote from the wellbore 22. Alternatively, the facility 64 can be an FPSO vessel, a rig, or tanker. Fluid flow to the processing facility 64 can be controlled with a control valve 65, shown included in the lead line to the processing facility 64. Formation fluids can be produced from the wellbore 22 after the non-production fluids are removed. The fluid entering the production flow line to the processing facility 64 can be monitored to detect formation fluid, which can indicate that the non-production fluids have been emptied from the wellbore 22. At this time, the production line 37 would contain almost exclusively produced formation fluids. Thus the control valve 65 can be closed so the fluid flowing in the production line 37 can be directed to a depot 66; where the depot 66 can be a storage site, refinery, or loading station. A control valve 67 is shown in the lead line to the depot 66, which can be opened to allow fluid flow to the depot 66.

After the pump module 40 is unlatched from the wellhead assembly 20, it can be raised on the retrieval line 58 and reconnected to another wellhead assembly 68. The wellhead assembly 68 can be located proximate to the wellhead assembly 20 or at a distal location. If the wellhead assembly 68 is at a distal location, the pump module 40 can be lifted onto the work boat 56, or another vessel, to be transported to the distal location. The ROV 60 can be used for disconnecting and connecting the pump module 40 from and to the wellhead assemblies 20, 68.

Optionally, the pump module 40 can be lowered from the work boat 56 on the tether 58 for attachment to the wellhead assembly 20. In one example of use, the pump module 40 is mounted to the production tree 26 and lowered by the work boat 56 onto the wellhead housing 24. The work boat 56 could remain in the vicinity during the period of time while the well 22 is being unloaded by the pump module 40 so that the module 40 can be retrieved and transported to another location either for use or possible refurbishment. One of the many advantages of the device and method described herein, is that equipment dedicated for unloading and/or well cleanup is no longer needed on the drilling rig. Moreover, the pump module is the only hardware required at a well for unloading the wellbore; the pump module as described can utilize piping circuits installed for normal well production to transfer the non-production fluids. As such, unloading a well with the pump module described herein eliminates the need to bring onsite a drilling rig, barge, or other well unloading units.

While the invention has been shown or described in only some of its forms, it should be apparent to those skilled in the art that it is not so limited, but is susceptible to various changes without departing from the scope of the invention.

What is claimed is:

1. A method of removing fluid from a subsea wellbore subsea wellhead assembly, the wellbore being in fluid communication with a producing formation, but containing a non-production fluid that impedes natural flow from the producing formation, the method comprising:

a. providing a pressurizing module comprising a pressurizing device with an entrance and an exit, a suction line having an end coupled to the pressurizing device entrance and a discharge line having an end coupled to the pressurizing device exit;

b. coupling the pressurizing module with the wellhead assembly so that the suction line is in fluid communication with the non-production fluid in the wellbore;

c. activating the pressurizing device to draw the non-production fluid from the wellbore, through the wellhead assembly and to the suction line, through the pressurizing device, and into the discharge line;

d. when a sufficient amount of the non-production fluid is withdrawn so that the production fluid is flowing naturally, deactivating the pressurizing device; and e. disconnecting the pressurizing device from the wellhead assembly, relocating the pressurizing module to another subsea wellhead assembly, and repeating steps (b), (c), and (d).

2. The method of claim 1, wherein step (d) comprises operating the pressurizing device until substantially all the non-production fluid removed from the wellbore.

3. The method of claim 1, wherein step (b) comprises lowering the pressurizing device from a vessel onto the wellhead assembly.

4. The method of claim 1, wherein step (b) comprises coupling the pressurizing device to a production tree and lowering the assembled pressurizing device and production tree onto the subsea wellhead assembly.

5. The method of claim 4, wherein the subsea wellhead assembly comprises a previously installed production tree, and step (b) comprises lowering the pressurizing device and production tree from a vessel onto the subsea wellhead assembly.

6. The method of claim 1, wherein the pressurizing module further comprises a housing, an axial bore in the housing that extends through a bottom side of the housing, wherein the suction line is in fluid communication with the axial bore.

7. The method of claim 6, wherein the bottom side of the housing is mounted onto the wellhead assembly and the axial bore is in fluid communication with an axial production bore formed in the wellhead assembly.

8. The method of claim 1, wherein the discharge line is in fluid communication with a production flow line that is in selective fluid communication with a non-production fluid processing facility, the method further comprising flowing the fluid from the discharge line into the production flow line and selectively flowing the fluid to the processing facility.

9. The method of claim 1, wherein a production port is provided on the wellhead assembly that is in fluid communication with the subsea wellbore, and wherein step (b) comprises connecting an end of the suction line opposite the pressurizing device to the production port.

* * * * *